US006631864B1

(12) United States Patent
Skalleberg

(10) Patent No.: US 6,631,864 B1
(45) Date of Patent: Oct. 14, 2003

(54) METHOD AND APPARATUS TO ROLL UP A CABLE, WIRE, ROPE OR THE LIKE IN A RING

(75) Inventor: Öystein Skalleberg, Nyhamnsläge (SE)

(73) Assignee: Skaltek AB, Kungsangen (SE)

( * ) Notice: Subject to any disclaimer, the term of this patent is extended or adjusted under 35 U.S.C. 154(b) by 0 days.

(21) Appl. No.: 09/959,743

(22) PCT Filed: May 2, 2000

(86) PCT No.: PCT/SE00/00829

§ 371 (c)(1),
(2), (4) Date: Feb. 5, 2002

(87) PCT Pub. No.: WO00/66474

PCT Pub. Date: Nov. 9, 2000

(30) Foreign Application Priority Data

May 3, 1999 (SE) ..... 9901576

(51) Int. Cl.[7] ..... B21C 47/24
(52) U.S. Cl. ..... 242/363
(58) Field of Search ..... 242/363, 362.1, 242/362.3, 475.7, 474.7, FOR 111

(56) References Cited

U.S. PATENT DOCUMENTS

| | | | | |
|---|---|---|---|---|
| 614,203 A | * | 11/1898 | Edwards et al. | 242/362.3 |
| 3,232,553 A | | 2/1966 | Kitselman | |
| 3,778,002 A | | 12/1973 | Alleweireldt | |
| 3,788,210 A | | 1/1974 | Lingemann | |
| 3,861,615 A | * | 1/1975 | Kinnicutt, Jr. | 242/363 X |
| 3,880,376 A | * | 4/1975 | Svensson | 242/362.3 |
| 3,881,340 A | | 5/1975 | Hay | |
| 4,154,269 A | | 5/1979 | Masahiko et al. | |
| 4,293,103 A | * | 10/1981 | Tsukamoto | 242/363 X |
| 4,714,209 A | | 12/1987 | Allard | |
| 4,883,230 A | | 11/1989 | Lindström | |
| 5,170,961 A | | 12/1992 | Bolz et al. | |
| 5,775,617 A | * | 7/1998 | Poloni | 242/363 |
| 5,829,705 A | | 11/1998 | Carlberg | |
| 6,158,683 A | * | 12/2000 | David et al. | 242/363 |

FOREIGN PATENT DOCUMENTS

| | | | | |
|---|---|---|---|---|
| DE | 1 168 732 | * | 4/1964 | 242/FOR 111 |
| DE | 1 574 357 | * | 11/1970 | 242/FOR 111 |
| EP | 0 578 301 A1 | | 1/1994 | |

* cited by examiner

*Primary Examiner*—Emmanuel Marcelo
(74) *Attorney, Agent, or Firm*—Young & Thompson

(57) ABSTRACT

A method and apparatus (1) for rolling up a cable (8), wire, rope or the like into a ring (38). An end part (36) of the cable (8) is fixed, by the weight from the rolled-up ring (38) of cable (8), between the rolled-up ring (38) of cable (8) and a support (48) on which the rolled-up ring (38) of cable (8) is placed. The rolled-up ring (38) of cable is advanced on the support (48) with the end part (36) fixed between the rolled-up ring (38) of cable (8) and the support (48).

17 Claims, 3 Drawing Sheets

METHOD AND APPARATUS TO ROLL UP A CABLE, WIRE, ROPE OR THE LIKE IN A RING

BACKGROUND OF THE INVENTION

The present invention relates to a method for rolling up a cable, wire, rope or the like into a ring. The invention also relates to an apparatus for rolling up a cable, wire, rope or the like into a ring.

Cables are supplied in various lengths by being rolled up into a ring. The ring of cable is packed in various types of packagings. A packaging commonly available on the market is constituted by a thin film packaging made from reusable plastic. To prevent the ring of cable from naturally unwinding before it is enclosed by the film packaging, a strap or the like is bound diametrically around the ring.

Providing the cable rolled up into a ring with a strap arranged diametrically around the ring means an increase in the total time for packing the ring and an increased use of resources, since more material is required to pack the ring. The strap only constitutes an aid during the packing of the cable, but performs no function once the cable has been enclosed by the film packaging.

SUMMARY OF THE INVENTION

The object of the invention is to eliminate the need for a strap or the like which is bound diametrically around a cable rolled up into a ring before the ring of cable is enclosed by a packaging.

This is achieved by a method of the type stated in the introduction, in which an end part of the cable is fixed, by the weight from the rolled-up ring of cable, between the rolled-up ring of cable and a support on which the rolled-up ring of cable is placed, and in which the rolled-up ring of cable is advanced on the support with the end part fixed between the rolled-up ring of cable and the support.

The fixing of the end part of the cable between the ring and the support prevents the ring from unwinding when it is advanced on a support. The geometric shape of the ring can thus be maintained until the film packaging has enclosed the ring. The consequence of this is that a strap or the like which is bound diametrically around the ring becomes superfluous.

There are a plurality of apparatuses or machines on the market which roll up a cable or the like into a ring and pack the ring in a packaging. Since the lengths of cable which are packed are very large in total and since each packaging with a cable rolled up into a ring contains a limited length of cable, the number of packed rings is very large. It is therefore desirable to minimize the quantity of packing material which is required to pack each ring of rolled-up cable.

Owing to the large length of cable which is packed, it is also desirable to increase the production rate in order thereby to reduce the production costs. By reducing the time it takes between a ring having been rolled up to the next ring being rolled up, the number of packed rings per unit of time can be increased. One wish is for the stoppage time between each commenced rolling-up of the cable to be eliminated, so that rolling-up and packeting of the cable is continuously ongoing in the apparatus.

When the cable is to be rolled up into a ring, it can sometimes occur that the cable end ends up askew, so that this cannot be fixed before the rolling-up is to commence. This means that it is not possible to produce a ring of the cable, thereby giving rise to an often costly interruption to the production.

Efforts are also being made to integrate a rolling-up and packing apparatus into the cable-manufacturing method. The insulation material is applied to the conductor by, for example, extrusion, which is achieved with a relatively fast feed rate for the conductor.

These means that the feed rate of the finished cable is high. In order to be able to roll up the finished cable directly after manufacture, the roll-up and packing apparatus must operate at essentially the same feed rate as the extrusion apparatus.

A further object of the invention is to reduce the production time spent packing the cable or the like.

Yet another object is to increase reliability during packaging of cable or the like in order to prevent production stoppage.

Yet another object is to integrate an apparatus for rolling up a cable or the like into a ring with a cable-manufacturing apparatus.

This is achieved by an apparatus of the type stated in the introduction, which comprises a first and second spool head, each provided with an axially displaceable core, on which spool heads the cable is arranged to be rolled up, which respective core comprises a gripping device for securing the cable and a cutting device for cutting the cable; a cable guide which is movable along an axis and which, in a first end position, directs the cable such that the cable coincides with a line extending from the cable guide to the periphery of a cable rolled up on the second spool head, the said line extending through a region occupied by the axial extent of the core of the first spool head, and which, in a second end position, directs the cable such that the cable coincides with a line extending from the cable guide to the periphery of a cable rolled up on the first spool head, the said line extending through a region occupied by the axial extent of the core of the second spool head.

Such an apparatus ensures that the stoppage time between rolling-up of two rings of cable is eliminated, which means that the number of packed rings per unit of time increases, thereby reducing the production cost. The feed rate of the cable in the apparatus can also be increased, which means that the apparatus can be integrated with a cable-manufacturing apparatus. The alternate winding of the cable on the first and second spool head means that there is no cable end which can end up askew at the commencement of each roll-up operation, which increases reliability and eliminates the risk of production stoppage. Using the apparatus according to the invention, it is also possible accurately to obtain a predetermined length of the cable wound into a ring.

BRIEF DESCRIPTION OF THE DRAWINGS

The invention will be described in greater detail below with reference to an illustrative embodiment shown in the appended drawings, in which.

DETAILED DESCRIPTION OF THE PREFERRED EMBODIMENTS

Figure 1:
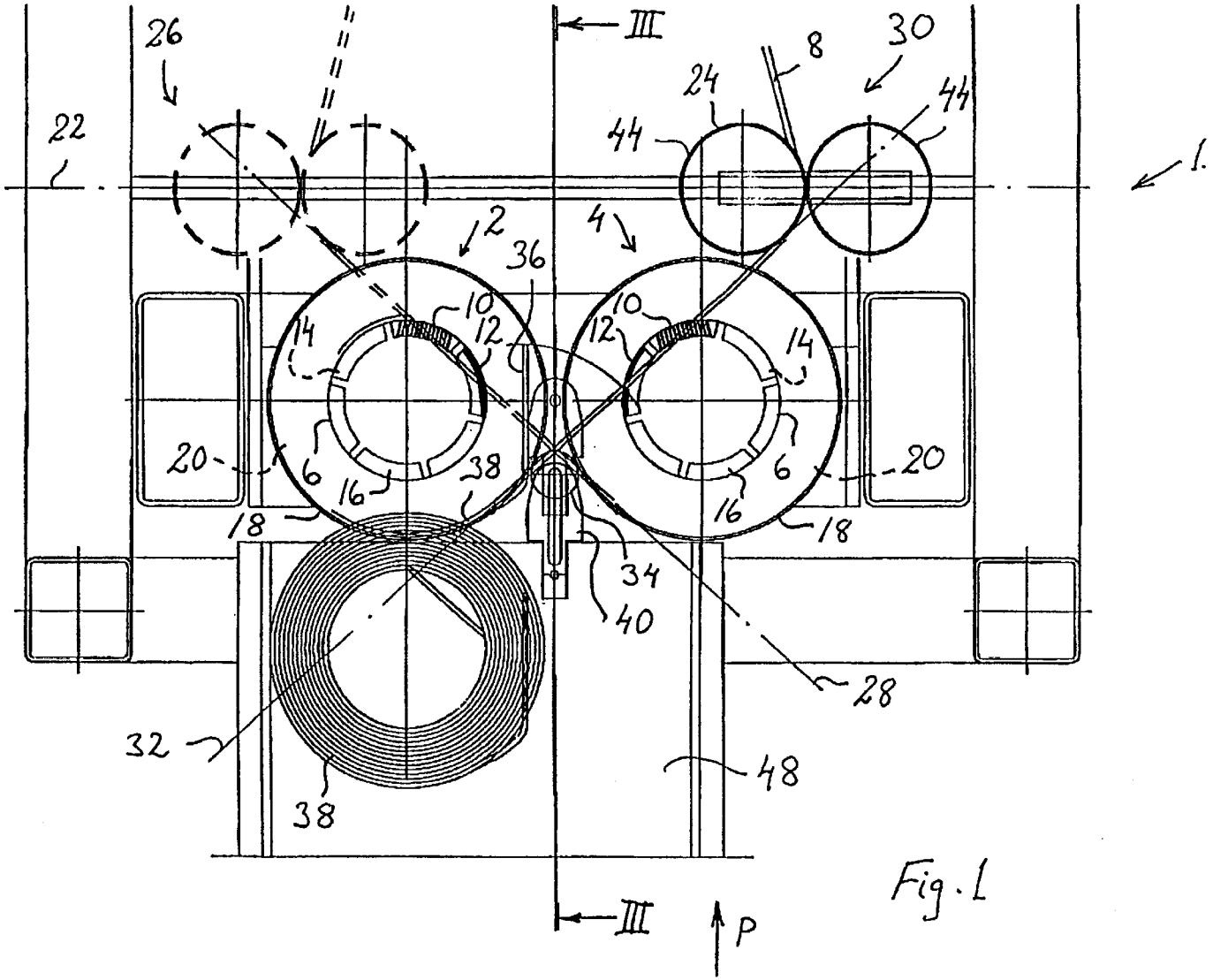
FIG. 1 shows a top view of an apparatus according to the invention.

FIG. 1 shows a top view of an apparatus 1 according to the invention. The apparatus 1 comprises a first and second spool head 2 and 4, each provided with an axially displaceable core 6. A cable 8 is arranged to be rolled up onto the core 6 of the respective spool head 2, 4. Each core 6 comprises a gripping device 10 for securing the cable 8 and a cutting device 12 for cutting the cable 8. The gripping device 10 comprises an element which is profiled on the end face 14 of the respective core 6 and the cutting device 12 comprises a knife edge disposed on the end face 14 of the respective core 6. The respective core 6 is an essentially circular cylinder and comprises around its circumference a plurality of arranged ribs 16, which are radially displaceable with a view to being able to vary the diameter of the core 6.

The first and second spool head 2, 4 each comprise an upper and lower flange 18, 20. The upper flange 18 is axially displaceable together with the core 6. The upper flange 18 can however be axially fixed, so that the core 6 can be axially displaced in relation to the upper flange 18. The respective lower flange 20 is rested upon by the rolled-up cable 8. The lower flange 20 also forms a counter-stay for the gripping and cutting device 10, 12, which will be explained in greater detail below.

The apparatus 1 according to the invention also comprises a cable guide 24 which is movable along an axis 22 and which, in a first end position 26, directs the cable 8 such that the cable 8 coincides with a line 28 extending from the cable guide 24 to the periphery of a cable 8 rolled up on the second spool head 4, the said line 28 extending through a region occupied by the axial extent of the core 6 of the first spool head 2. FIG. 1 shows, for clarification purposes, how the cable guide 24 is placed in a first and second end position 26, 30. In the first end position 26 in FIG. 1, the cable guide 24 is only indicated with dashed lines.

In the second end position 30 of the cable guide 24, the cable guide 24 directs the cable 8 in a corresponding manner so that the cable 8 coincides with a line 32 extending from the cable guide 24 to the periphery of a cable 8 rolled up on the first spool head 2, the said line 32 extending through a region occupied by the axial extent of the core 6 of the second spool head 4.

The apparatus 1 also comprises a plunger 34, which is arranged to displace an end part 36 of the cable 8 whenever a ring 38 of cable 8 has been rolled up onto one of the spool heads 2, 4. The cable 8 is displaced, so that the level for a section of the extent of the cable 8 ends up below a horizontal plane coinciding with the respective lower flange 20 of the spool head 2, 4. This means that the end part 36 of the cable 8 can be inserted beneath the lower flange 20 after the cable 8 has been cut by the cutting device 12. The insertion of the end part 36 beneath the flange 20 is carried out using a slide block 40 which is displaceable in the apparatus 1.

The apparatus 1 also comprises a conveyor belt 42 which is displaceable in the lateral direction and on which cables 8 rolled up into rings 38 are transported from the respective spool head 2, 4 to a packeting apparatus (not shown).

The working of the apparatus 1 and the method for rolling up the cable 8 using the apparatus 1 will be explained below.

Cable 8 comes into the apparatus 1 from an extrusion apparatus or a magazine, such as a cable winder (not shown), which houses a large length of cable 8. The cable 8 runs onward over the cable guide 24, which travels to and fro and comprises two sheaves 44. From the cable guide 24, the cable 8 is guided onward to the spool heads 2, 4. In order to roll up the cable 8 onto the first spool head 2, the core 6 of the first spool head 2 will initially be axially displaced to a distance from the lower flange 20 of the first spool head 2. The cable guide 24 will preferably be placed from the beginning in its first end position 26, which corresponds to the end position shown on the left in FIG. 1. The cable 8 is stretched so that the cable 8 extends along a line 28 extending through a region occupied by the axial extent of the core 6 of the first spool head 2. In this position, the core 6 of the first spool head 2 is guided with force in an axial direction towards the lower flange 20, so that the cable 8 is gripped between the gripping device 10 on the end face 14 of the core 6 and the lower flange 20. At the same time, the cable 8 is cut by the cutting device 12, which is disposed on the end face 14 of the core 6. After this, the first spool head 2 is made to rotate, so that the cable 8 is rolled up onto the core 6 of the first spool head 2.

As the cable 8 is being rolled up onto the core 6 of the first spool head 2, the cable guide 24 moves in the direction of its second end position 30. The core 6 of the second spool head 4 is then axially displaced to a distance from the lower flange 20 of the second spool head 4, so that the cable 8 can extend along a line 32 which extends through a region occupied by the axial extent of the core 6 of the second spool head 4, as is shown in FIG. 1. Once the desired length has been rolled up onto the core 6 of the first spool head 2, the core 6 of the second spool head 4 is guided with force in an axial direction towards the lower flange 20, so that the cable 8 is gripped between the gripping device 10 on the end face 14 of the core 6 and the lower flange 20. At the same time, the cable 8 is cut by the cutting device 12, which is disposed on the end face 14 of the core 6. After this, the second spool head 4 is made to rotate, so that the cable 8 is rolled up onto the core 6 of the second spool head 4.

Figure 2:
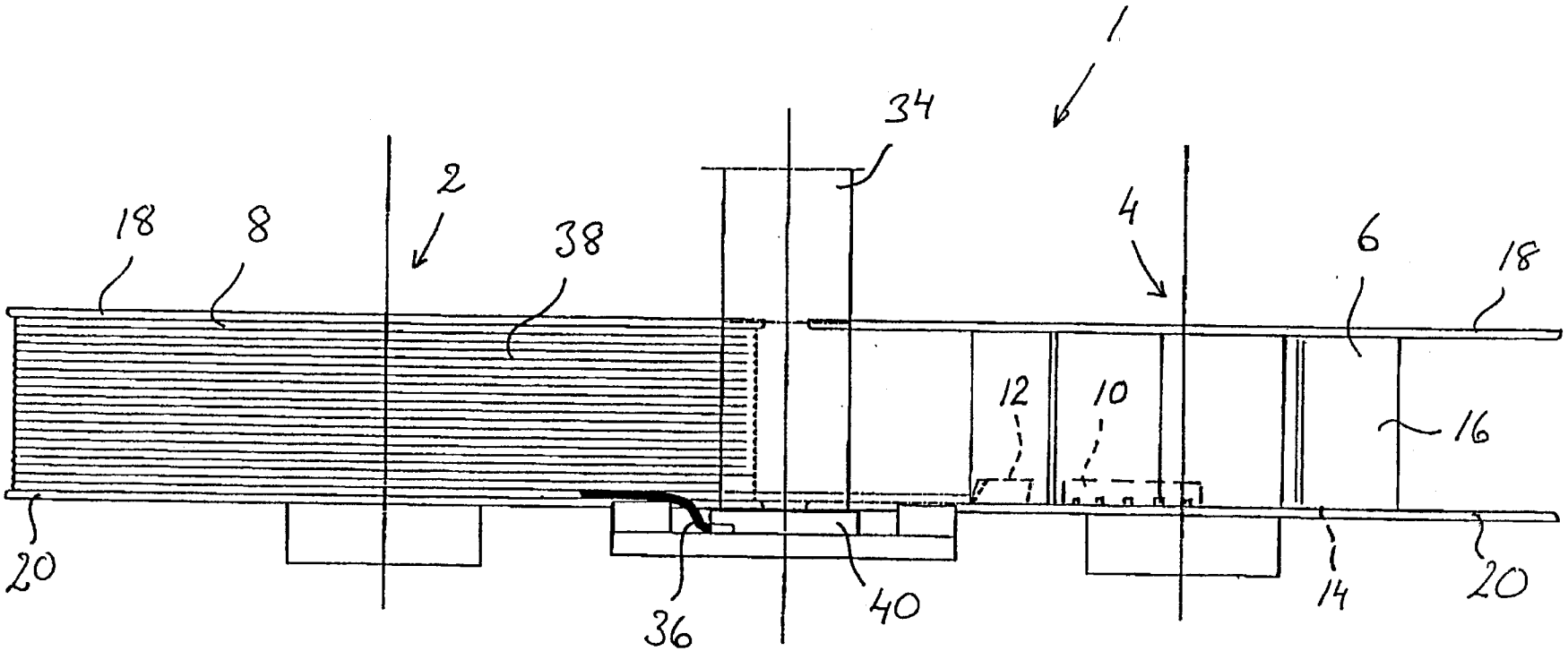
FIG. 2 shows a front view of the apparatus in FIG. 1.

Before or at the same time as the cable 8 is cut by the cutting device 12 on the core 6 of the second spool head 4, the plunger 34 is guided down in the direction of the cable 8 and displaces the cable 8, so that a section of the extent of the cable 8 ends up at a level below a horizontal plane coinciding with the lower flange 20 of the first spool head 2. This is best shown in FIG. 2, which constitutes a simplified front view of the apparatus 1 viewed in the direction of the arrow P in FIG. 1.

Figure 3:
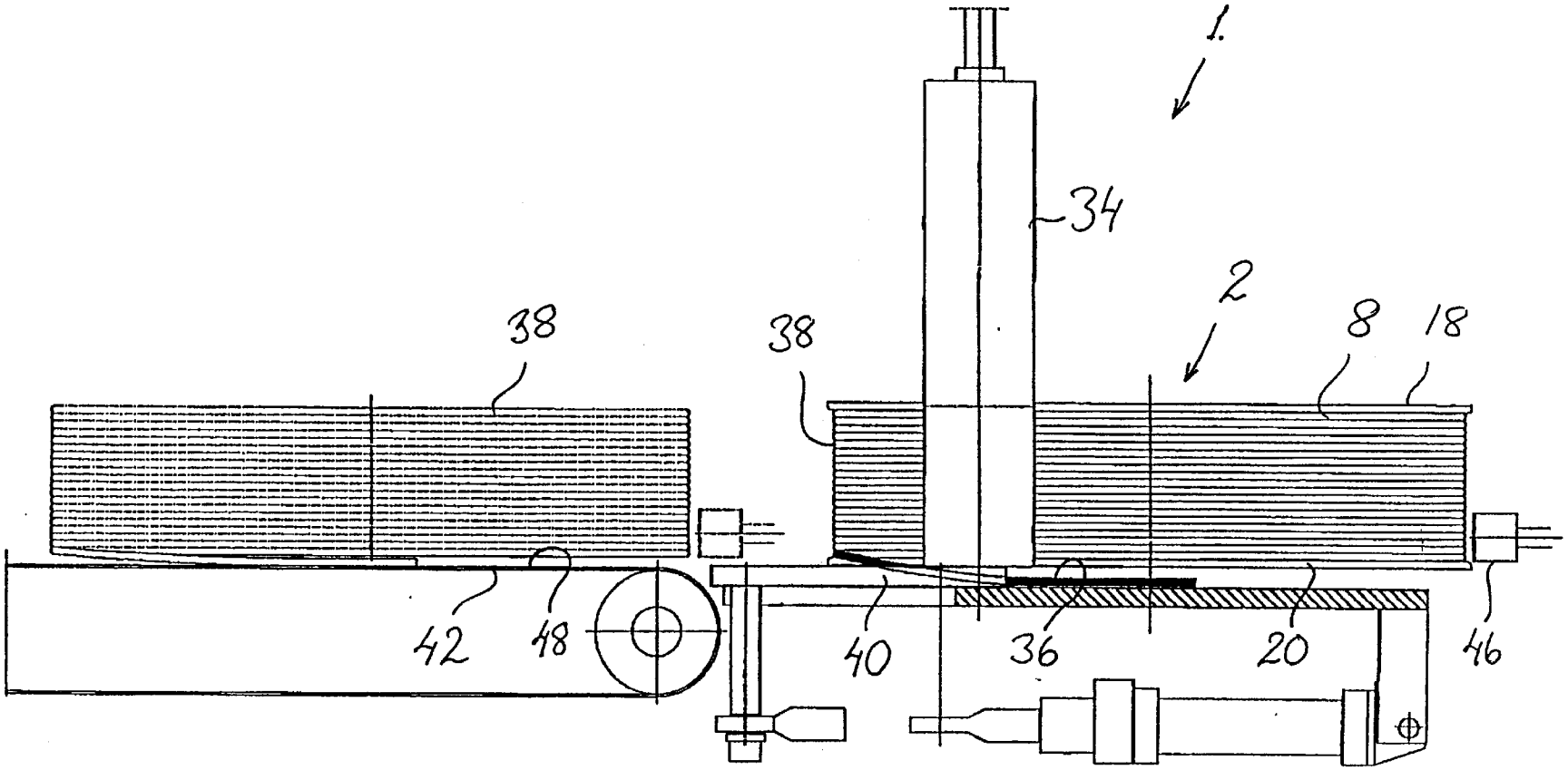
FIG. 3 shows a sectional view along the line III—III in FIG. 1.

Once a section of the cable 8 has been displaced by the plunger 34 and the cable 8 has been cut by the cutting device 12 on the core 6 of the second spool head 4, so that an end part 36 of the cable 8 has been formed, the end part 36 is guided beneath the lower flange 20 of the first spool head 2 with the aid of the displaceable slide block 40, which is best shown in FIGS. 1 and 3. FIG. 3 represents a sectional view along the line III—III in FIG. 1. The slide block 40 places the end part 36 of the cable 8 beneath the lower flange 20 such that the end part 36 extends essentially linearly and such that the linear section of the end part 36 at least partially coincides with a direction of feed for the rolled-up ring 38 of cable 8. After this, the core 6 and the upper flange 18 of the first spool head 2 are displaced in the direction away from the lower flange 20, so that the formed ring 38 of cable 8 can be fed out from the first side of head 2 with the aid of a feed-out mechanism 46, as is shown in FIG. 3, and placed on the conveyor belt 42, which forms a support 48 for the rolled-up cable 8. The end part 36 of the cable 8 is thereby fixed between the rolled-up ring 38 of cable 8 and the support 48 on which the rolled-up ring 38 of cable 8 is placed with the aid of the weight from the rolled-up ring 38 of cable 8. The rolled-up ring 38 of cable 8 is subsequently fed onward by the conveyor belt 42 to a packeting apparatus (not shown)

As the cable 8 is being rolled up onto the core 6 of the second spool head 4 and at the same time as the rolled-up ring 38 of cable 8 is fed out from the first spool head 2, the cable guide 24 moves back in the direction of its first end position 26. The core of the first spool head 2 is then axially displaced to a distance from the lower flange 20 of the first spool head 2, so that the cable 8 can extend along a line 28 which extends through a region occupied by the axial extent of the core 6 of the first spool head 2. Once the desired length has been rolled up onto the core 6 of the first spool head 2, the core 6 of the first spool head 2 is guided with force in an axial direction towards the lower flange 20, so that the cable 8 is gripped between the gripping device 10 on the end face 14 of the core 6 and the lower flange 20. At the same time, the cable 8 is cut by the cutting device 12, which is disposed on the end face 14 of the core 6. As the cable 8 was being rolled up onto the core 6 of the second spool head 4, the conveyor belt 42 was displaced in the lateral direction and placed in front of the second spool head 4.

Before or at the same time as the cable 8 is cut by the cutting device 12 on the core 6 of the first spool head 2, the plunger 34 is guided down in the direction of the cable 8 and displaces the cable 8, so that the slide block 40 can guide the end part 36 of the cable 8 beneath the lower flange 20 of the first spool head 2. At the same time, the cable 8 is begun to be rolled up onto the second spool head 4, as has been described above, so that alternate rolling-up of the cable 8 is achieved in the apparatus 1 according to the invention.

What is claimed is:

1. Method for rolling up a cable, wire, or rope having a starting end and a terminating end into a ring, comprising the steps of:

fixing the terminating end of the cable, using the weight of the rolled-up ring of cable, between the rolled-up ring of cable and a support on which the rolled-up ring of cable is placed, and advancing the rolled-up ring of cable in relation to the support with the terminating end fixed between the rolled-up ring of cable and the support.

2. Method according to claim 1, wherein the terminating end is placed between the rolled-up ring of cable and the support such that the terminating end extends essentially linearly and such that the linear section of the terminating end at least partially coincides with a direction of feed for the rolled-up ring of cable.

3. Method according to claim 2, wherein the rolled-up ring of cable is advanced on the support in a direction which essentially coincides with the linear section of the terminating end.

4. The method as claimed in claim 1 further comprising the steps of rolling the cable about a core and then removing the rolled-up cable from the core when placing the rolled-up cable on the support.

5. Apparatus for rolling up a cable, wire, or rope, into a ring, comprising:

a first and second spool head, each provided with a core that is axially displaceable with respect to the cable, on which spool heads the cable is arranged to be rolled up, each respective core comprises a gripping device for securing the cable and a cutting device for cutting the cable; and a cable guide which is movable along an axis and which, in a first end position, directs the cable such that the cable essentially coincides with a first line extending from the cable guide to the periphery of the cable rolled up on the second spool head, said first line extending through a region occupied by the axial extent of the core of the first spool head, and which, in a second end position, directs the cable such that the cable essentially coincides with a second line extending from the cable guide to the periphery of the cable rolled up onto the first spool head, said second line extending through a region occupied by the axial extent of the core of the second spool head.

6. Apparatus according to claim 5, wherein each respective core is an essentially circular cylinder and the gripping device comprises an element which is profiled on an end face of the respective core and the cutting device comprises a knife edge disposed on the end face of the respective core.

7. Apparatus according to claim 5, characterized in that the respective core (6) comprises a plurality of ribs (16) arranged around the circumference of the core (6).

8. Apparatus according to claim 5, characterized in that a plunger (34) is arranged to displace an end part (36) of the cable (8).

9. Apparatus according to claim 8, characterized in that a displaceable slide block (40) is arranged to displace the end part (36) of the cable (8) onto the bottom side of a flange (20) of the spool head (2, 4), on which flange (20) the rolled-up cable (8) rests.

10. Apparatus according to claim 5, characterized in that a feed-out mechanism (46) is arranged to advance the rolled-up ring (38) of cable (8) such that an end part (36) of the cable (8) is fixed, by the weight from the rolled-up ring (38) of cable (8), between the rolled-up ring (38) of cable (8) and a support (48) on which the rolled-up ring (38) of cable (8) is placed.

11. Apparatus according to claim 10, characterized in that the end part (36) is placed between the rolled-up ring (38) of cable (8) and the support (48) such that the end part (36) extends essentially linearly and such that the linear section of the end part (36) at least partially coincides with a direction of feed for the rolled-up ring (38) of cable (8).

12. Apparatus according to claim 10, characterized in that the feed-out mechanism (46) feeds out the rolled-up ring (38) of cable (8) such that the ring (38) is advanced on the support (48) in a direction which essentially coincides with the linear section of the end part (36).

13. Apparatus according to claim 9, characterized in that the feed-out mechanism (46) feeds out the rolled-up ring (38) of cable (8) such that the ring (38) is advanced on the support (48) in a direction which essentially coincides with the linear section of the end part (36).

14. An apparatus for rolling up a cable, wire or rope into a ring, comprising:

a spool head, said cable being wound around said spool head;

a gripping device for gripping a first end of the cable, before the cable is wound around the spool head;

a cutting device for cutting a second end of the cable, after the cable is wound around the spool head; and a displacement device to displace said second end of the cable with respect to the spool head.

15. The apparatus according to claim 14, further comprising a displaceable slide block to displace the second end of the cable onto a bottom side of a flange of the spool head.

16. The apparatus according to 14, further comprising a feed-out mechanism to advance a rolled-up ring of cable so that said second end of the cable is fixed between the rolled-up ring of cable and a support on which the rolled-up ring of cable is placed using the weight of the rolled-up ring of cable.

17. The apparatus according to 16, wherein the spool head further comprises a core that is axially displaceable with respect to the rolled-up ring of cable.

* * * * *